US011348533B1

(12) United States Patent
Ono et al.

(10) Patent No.: US 11,348,533 B1
(45) Date of Patent: May 31, 2022

(54) METHODS AND APPARATUS FOR ACCELERATING SCAN SIGNAL FALL TIME TO REDUCE DISPLAY BORDER WIDTH

(71) Applicant: Apple Inc., Cupertino, CA (US)

(72) Inventors: Shinya Ono, Cupertino, CA (US); Chin-Wei Lin, San Jose, CA (US); Gihoon Choo, Santa Clara, CA (US); Shiping Shen, Cupertino, CA (US); Jie Won Ryu, Campbell, CA (US); Zino Lee, Gyeonggi-do (KR); Hassan Edrees, Cupertino, CA (US); Ting-Kuo Chang, San Jose, CA (US)

(73) Assignee: Apple Inc., Cupertino, CA (US)

( * ) Notice: Subject to any disclaimer, the term of this patent is extended or adjusted under 35 U.S.C. 154(b) by 104 days.

(21) Appl. No.: 16/864,241

(22) Filed: May 1, 2020

Related U.S. Application Data

(60) Provisional application No. 62/861,241, filed on Jun. 13, 2019.

(51) Int. Cl.
*G09G 3/3266* (2016.01)

(52) U.S. Cl.
CPC ..... *G09G 3/3266* (2013.01); *G09G 2300/043* (2013.01); *G09G 2310/08* (2013.01); *G09G 2320/0209* (2013.01)

(58) Field of Classification Search
CPC ..... G09G 3/3266; G09G 2300/043; G09G 2310/08; G09G 2320/0209
See application file for complete search history.

(56) References Cited

U.S. PATENT DOCUMENTS

| | | | | |
|---|---|---|---|---|
| 10,019,933 | B2 | 7/2018 | Takahara | |
| 10,438,540 | B2 | 10/2019 | Yang et al. | |
| 2003/0043104 | A1* | 3/2003 | Lee | G02F 1/1345 345/92 |
| 2008/0165110 | A1* | 7/2008 | Kim | G11C 19/184 345/99 |
| 2008/0211760 | A1* | 9/2008 | Baek | G11C 19/184 345/98 |
| 2009/0144024 | A1* | 6/2009 | Oppold | H01L 22/34 702/182 |

(Continued)

FOREIGN PATENT DOCUMENTS

CN 103199096 B 12/2014

*Primary Examiner* — Antonio Xavier
(74) *Attorney, Agent, or Firm* — Treyz Law Group, P.C.; Jason Tsai

(57) ABSTRACT

A display may include an array of pixels, where each pixel in the array includes an organic light-emitting diode coupled to associated thin-film transistors. The thin-film transistors may be controlled using at least first and second horizontal scan line signals. Loading different data values into any given row in the array may cause the scan line signals to exhibit varying rise/fall times, which results in horizontal crosstalk and luminance non-uniformity across the display. The rise and fall times of the second scan line signal are crucial, so the second scan line signal is driven by two separate scan line drivers formed on both sides of the display. Only the fall time of the first scan line signal is crucial, so the first scan line signal is driven by only one peripheral scan line driver and is coupled to an auxiliary pull-down circuit that is only activated during the pull-down transition.

21 Claims, 14 Drawing Sheets

(56) References Cited

U.S. PATENT DOCUMENTS

| | | | | |
|---|---|---|---|---|
| 2010/0182227 | A1* | 7/2010 | Tsou | G09G 3/3677 345/100 |
| 2013/0300681 | A1* | 11/2013 | Jamshidi-Roudbari | G06F 3/044 345/173 |
| 2015/0055051 | A1* | 2/2015 | Osawa | H01L 27/3262 349/48 |
| 2015/0356934 | A1* | 12/2015 | Yamashita | G11C 19/28 345/205 |
| 2016/0171933 | A1* | 6/2016 | Takahara | G09G 3/3258 345/212 |
| 2016/0224175 | A1* | 8/2016 | Moon | G09G 3/20 |
| 2016/0358567 | A1* | 12/2016 | Tomida | H01L 29/41733 |
| 2017/0005654 | A1* | 1/2017 | Zhang | H03F 3/2178 |
| 2017/0162113 | A1* | 6/2017 | Lin | H01L 27/1225 |
| 2017/0162114 | A1* | 6/2017 | Ono | G09G 3/3233 |
| 2017/0365214 | A1* | 12/2017 | Tsai | G09G 3/3233 |
| 2019/0088206 | A1* | 3/2019 | Lin | G09G 3/3266 |
| 2019/0096332 | A1 | 3/2019 | Park et al. | |

* cited by examiner

METHODS AND APPARATUS FOR ACCELERATING SCAN SIGNAL FALL TIME TO REDUCE DISPLAY BORDER WIDTH

This application claims the benefit of provisional patent application No. 62/861,241, filed Jun. 13, 2019, which is hereby incorporated by reference herein in its entirety.

BACKGROUND

This relates generally to electronic devices with displays and, more particularly, to display driver circuitry for displays such as organic light-emitting diode (OLED) displays.

Electronic devices often include displays. For example, cellular telephones and portable computers typically include displays for presenting image content to users. OLED displays have an array of display pixels based on light-emitting diodes. In this type of display, each display pixel includes a light-emitting diode and associated thin-film transistors for controlling application of data signals to the light-emitting diode to produce light.

The display further includes row driver circuits configured to generate control signals to the thin-film transistors within each display pixel. The row driver circuits may generate one or more scan control signals and emission control signals for selectively enabling and disabling the thin-film transistors during different phases of operation of the display pixels.

Consider a scenario in which first and second display pixels along a given column of the pixel array are supplied with identical data values and thus should ideally exhibit the same display output. In practice, however, display pixels located along the same row as the second pixel may be provided with different data values, which can cause horizontal crosstalk that will inadvertently alter the desired output of the second pixel. It is within this context that the embodiments herein arise.

SUMMARY

An electronic device may include a display having an array of display pixels. The display pixels may be organic light-emitting diode display pixels. Each display pixel may include an organic light-emitting diode (OLED) that emits light, a drive transistor coupled in series with the OLED, and other associated transistors configured to receive at least a first scan line signal via a first scan line and a second scan line signal via a second scan line. The display may further include first and second peripheral driver circuits configured to drive the second scan line signal on the second scan line and a single peripheral driver circuit configured to drive the first scan line signal on the first scan line, where the first scan line signal is asserted by only the single peripheral driver circuit.

The first and second peripheral driver circuits may be formed on opposing sides of the array. The first and second peripheral driver circuits are configured to pulse the second scan line signal on the second scan line, whereas the single peripheral driver circuit is formed on only one side of the array. The display may further include an auxiliary pull-down circuit coupled to the first scan line. The auxiliary pull-down circuit may be only configured to deassert (e.g., pull down) the first scan line signal. The auxiliary pull-down circuit may be activated by another scan line signal from an adjacent row or a non-adjacent row in the array. If desired, the auxiliary pull-down circuit may be overdriven to decrease the on resistance of the auxiliary pull-down circuit, thereby further improving fall time performance.

Configured in this way, the second scan line may be symmetrically driven (using peripheral row drivers on both ends) whereas the first scan line is asymmetrically driven (using only one peripheral row driver on one end and assisted by the auxiliary pull-down circuit). Moreover, the falling pulse edge of the first scan line signal may be further delayed with respect to the rising pulse edge of the second scan line signal to reduce horizontal crosstalk and ensure luminance uniformity across the display.

DETAILED DESCRIPTION

Figure 1:
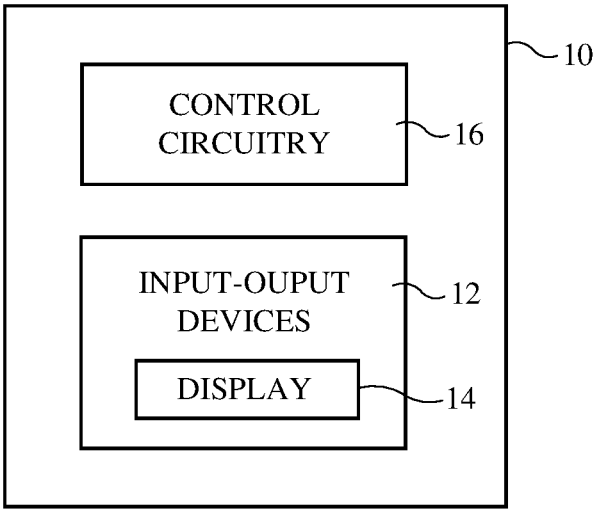
FIG. 1 is a diagram of an illustrative electronic device having a display in accordance with an embodiment.

An illustrative electronic device of the type that may be provided with a display is shown in FIG. 1. As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

Control circuitry 16 may be used to run software on device 10 such as operating system code and applications. During operation of device 10, the software running on control circuitry 16 may display images on display 14 using an array of pixels in display 14. Device 10 may be a tablet computer, laptop computer, a desktop computer, a display, a cellular telephone, a media player, a wristwatch device or other wearable electronic equipment, or other suitable electronic device.

Display 14 may be an organic light-emitting diode display or may be a display based on other types of display technology. Configurations in which display 14 is an organic light-emitting diode (OLED) display are sometimes described herein as an example. This is, however, merely illustrative. Any suitable type of display may be used in device 10, if desired.

Display 14 may have a rectangular shape (i.e., display 14 may have a rectangular footprint and a rectangular peripheral edge that runs around the rectangular footprint) or may have other suitable shapes. Display 14 may be planar or may have a curved profile.

Figure 2:
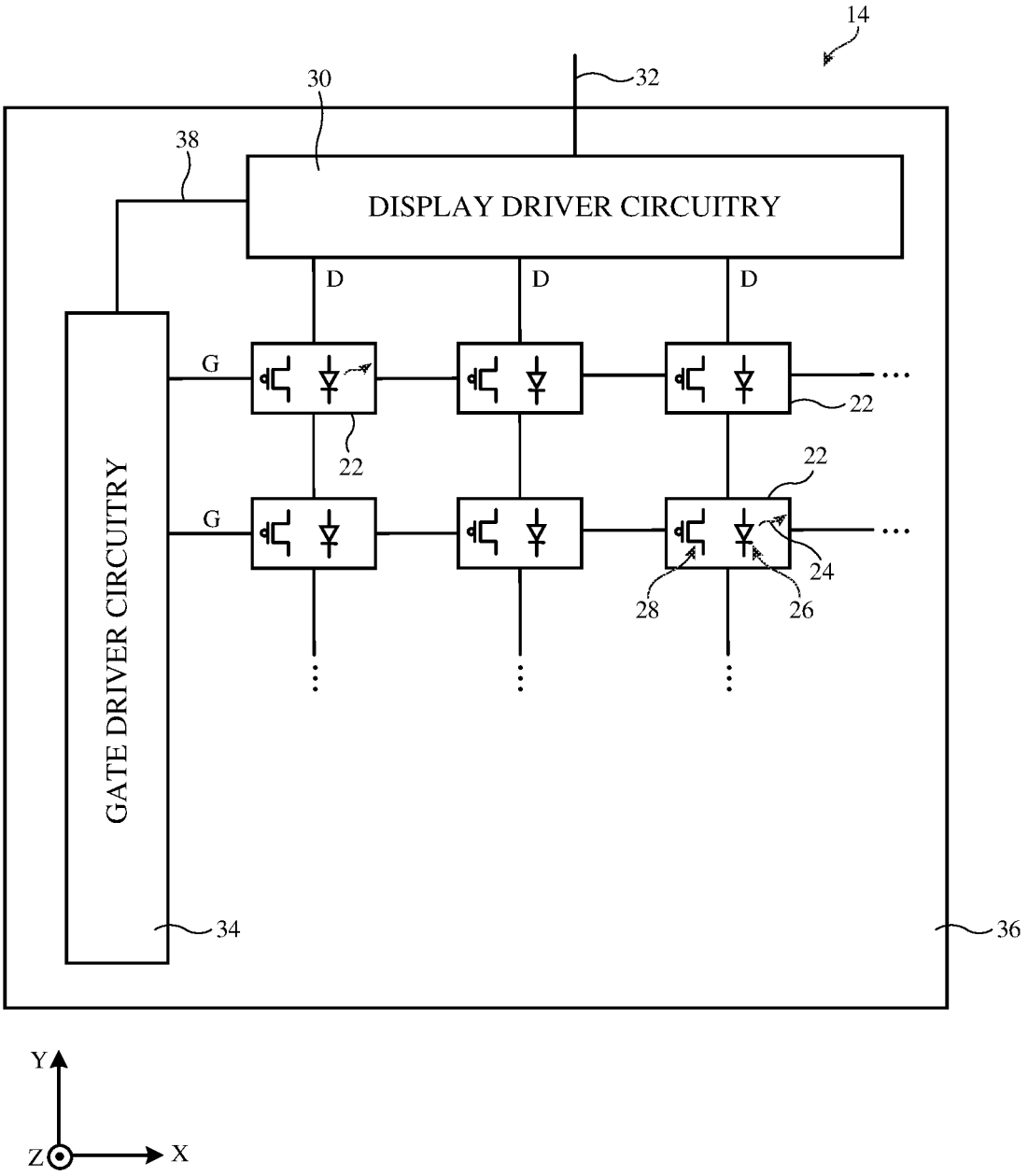
FIG. 2 is a diagram of an illustrative display having an array of organic light-emitting diode display pixels in accordance with an embodiment.

A top view of a portion of display 14 is shown in FIG. 2. As shown in FIG. 2, display 14 may have an array of pixels 22 formed on a substrate 36. Substrate 36 may be formed from glass, metal, plastic, ceramic, porcelain, or other substrate materials. Pixels 22 may receive data signals over signal paths such as data lines D and may receive one or more control signals over control signal paths such as horizontal control lines G (sometimes referred to as gate lines, scan lines, emission lines, etc.). There may be any suitable number of rows and columns of pixels 22 in display 14 (e.g., tens or more, hundreds or more, or thousands or more).

Each pixel 22 may have a light-emitting diode 26 that emits light 24 under the control of a pixel control circuit formed from thin-film transistor circuitry such as thin-film transistors 28 and thin-film capacitors). Thin-film transistors 28 may be polysilicon thin-film transistors, semiconducting-oxide thin-film transistors such as indium zinc gallium oxide transistors, or thin-film transistors formed from other semiconductors. Pixels 22 may contain light-emitting diodes of different colors (e.g., red, green, and blue) to provide display 14 with the ability to display color images.

Display driver circuitry 30 may be used to control the operation of pixels 22. The display driver circuitry 30 may be formed from integrated circuits, thin-film transistor circuits, or other suitable electronic circuitry. Display driver circuitry 30 of FIG. 2 may contain communications circuitry for communicating with system control circuitry such as control circuitry 16 of FIG. 1 over path 32. Path 32 may be formed from traces on a flexible printed circuit or other cable. During operation, the control circuitry (e.g., control circuitry 16 of FIG. 1) may supply circuitry 30 with information on images to be displayed on display 14.

To display the images on display pixels 22, display driver circuitry 30 may supply image data to data lines D (e.g., data lines that run down the columns of pixels 22) while issuing clock signals and other control signals to supporting display driver circuitry such as gate driver circuitry 34 over path 38. If desired, display driver circuitry 30 may also supply clock signals and other control signals to gate driver circuitry 34 on an opposing edge of display 14 (e.g., the gate driver circuitry may be formed on more than one side of the display pixel array).

Gate driver circuitry 34 (sometimes referred to as horizontal line control circuitry or row driver circuitry) may be implemented as part of an integrated circuit and/or may be implemented using thin-film transistor circuitry. Horizontal/row control lines G in display 14 may carry gate line signals (scan line control signals), emission enable control signals, and/or other horizontal control signals for controlling the pixels of each row. There may be any suitable number of horizontal control signals per row of pixels 22 (e.g., one or more row control lines, two or more row control lines, three or more row control lines, four or more row control lines, five or more row control lines, etc.).

Figure 3:
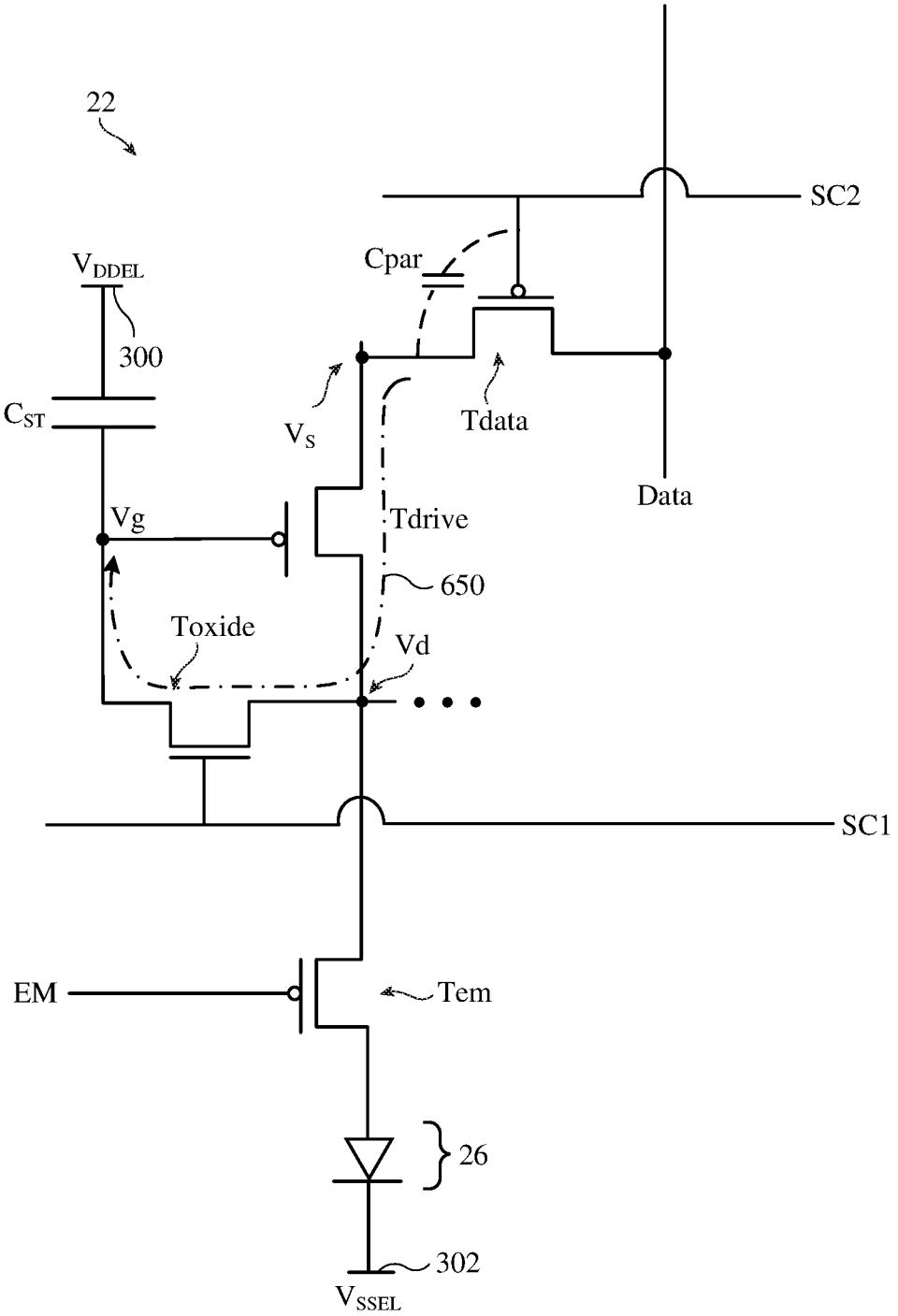
FIG. 3 is a diagram of an illustrative organic light-emitting diode display pixel in accordance with an embodiment.

FIG. 3 is a circuit diagram of an illustrative organic light-emitting diode display pixel 22 in display 14. As shown in FIG. 3, display pixel 22 may include at least a storage capacitor Cst, an n-type (i.e., n-channel) transistor such as semiconducting-oxide transistor Toxide, and p-type (i.e., p-channel) transistors such as a drive transistor Tdrive, a data loading transistor Tdata, and an emission transistor Tem. While transistor Toxide is formed using semiconducting oxide (e.g., a transistor with a channel formed from semiconducting oxide such as indium gallium zinc oxide or IGZO), the other p-channel transistors may be thin-film transistors formed from a semiconductor such as silicon (e.g., polysilicon channel deposited using a low temperature process, sometimes referred to as LTPS or low-temperature polysilicon). Semiconducting-oxide transistors exhibit relatively lower leakage than silicon transistors, so implementing transistor Toxide as a semiconducting-oxide transistor will help reduce flicker (e.g., by preventing current from leaking away from the gate terminal of drive transistor Tdrive).

In another suitable arrangement, transistors Toxide and Tdrive may be implemented as semiconducting-oxide transistors while any remaining transistors within pixel 22 are LTPS transistors. If desired, any of the remaining transistors Tdata, Tem, and others may be implemented as semiconducting-oxide transistors. Moreover, any one or more of the p-channel transistors may be n-type (i.e., n-channel) thin-film transistors.

Display pixel 22 may further include an organic light-emitting diode (OLED) 26. A positive power supply voltage VDDEL may be supplied to positive power supply terminal 300, and a ground power supply voltage VSSEL may be supplied to ground power supply terminal 302. Positive power supply voltage VDDEL may be 3 V, 4 V, 5 V, 6 V, 7 V, 2 to 8 V, or any suitable positive power supply voltage level. Ground power supply voltage VSSEL may be 0 V, −1 V, −2 V, −3 V, −4 V, −5 V, −6V, −7 V, or any suitable ground or negative power supply voltage level. The state of drive transistor Tdrive controls the amount of current flowing from terminal 300 to terminal 302 through diode 304, and therefore the amount of emitted light from display pixel 22.

In the example of FIG. 3, storage capacitor Cst may be coupled between power supply terminal 300 and the gate terminal of p-type transistor Tdrive. Transistor Toxide may have a first source-drain terminal connected to the gate terminal of transistor Tdrive, a second source-drain terminal connected to the drain terminal of transistor Tdrive, and a gate terminal configured to receive a first scan control signal SC1. Emission transistor may be coupled in series between transistor Tdrive and light-emitting diode 25 and may have a gate terminal configured to receive an emission control signal EM. Data loading transistor Tdata may have a first source-drain terminal connected to the source terminal of transistor Tdrive, a second source-drain terminal connected to the data line, and a gate terminal configured to receive a second scan control signal SC2. Scan control signals SC1 and SC2 may be provided over row control lines (see lines G in FIG. 2). Although pixel 22 is shown to include only four thin-film transistors, pixel 22 may generally include any suitable number of transistors (e.g., pixel 22 may include additional emission transistors, initialization transistors, etc.) and capacitors (e.g., pixel 22 may include at least two capacitors or more than two capacitors).

Pixel 22 may be subject to process, voltage, and temperature (PVT) variations. Due to such variations, transistor threshold voltages between different display pixels 22 may vary. Most importantly, variations in the threshold voltage of transistor Tdrive can cause different display pixels 22 to produce amounts of light that do not match the desired image. In an effort to mitigate threshold voltage variations, display pixel 22 of the type shown in FIG. 3 may be operable to support in-pixel threshold voltage (Vth) compensation. In-pixel threshold voltage (Vth) compensation operations, sometimes referred to as an in-pixel Vth canceling scheme, may generally include at least an initialization phase, a threshold voltage sampling phase, a data programming phase, and an emission phase. During the threshold voltage sampling phase, the threshold voltage of transistor Tdrive may be sampled using storage capacitor Cst. Subsequently, during the emission phase, emission current flowing through transistor Tem into the light-emitting diode 26 may have a term that cancels out with the sampled Vth. As a result, the emission current will be independent of the drive transistor Vth and therefore be immune to any Vth variations at the drive transistor.

Figure 4:
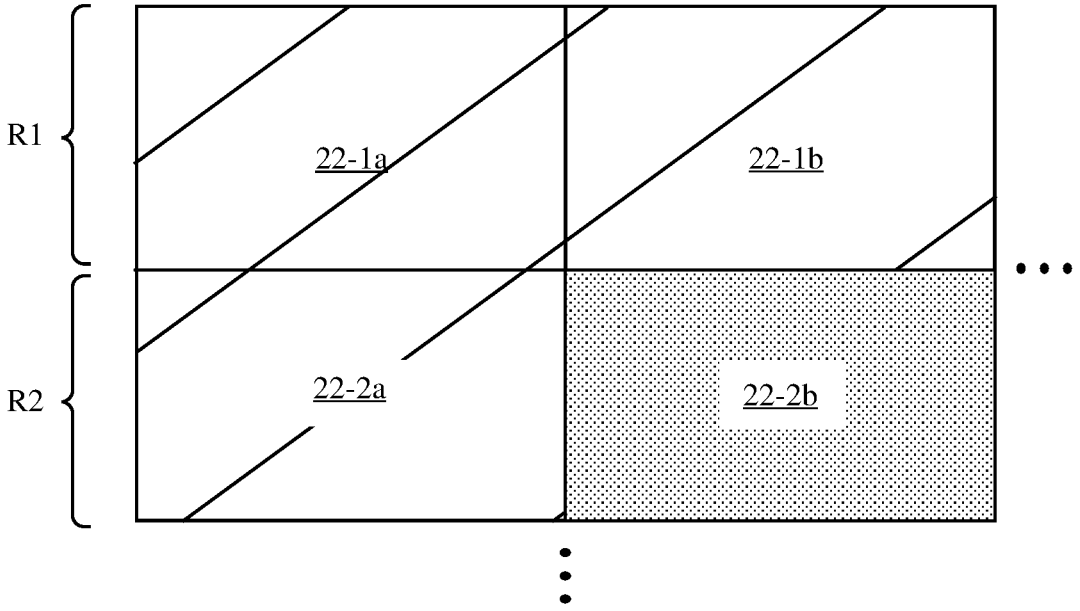
FIG. 4 is a diagram showing how two rows of display pixels may be provided with different data values in accordance with an embodiment.

Another technical issue that may arise in display 14 formed using pixel 22 of the type shown in FIG. 3 is the fact that transistors Tdata and Toxide controlled by the scan line signals exhibit transistor capacitance values that vary depending on the data value that is being loaded in from the associated data line. FIG. 4 is a diagram showing how two rows of display pixels 22 may be provided with different data values. As shown in FIG. 4, the first row R1 includes pixels 22-*la* and 22-1*b*, both of which are provided with gray values (as illustrated by the shading of those two pixels). In contrast, the second row R2 includes pixel 22-2*a* provided with the same gray value as the first row T1 and pixel 22-2*b* provided with a black value (as illustrated by the blackened pixel). The data values of other display pixels in the array are omitted in order to avoid complicating the discussion of the technical issues.

Figure 5A:
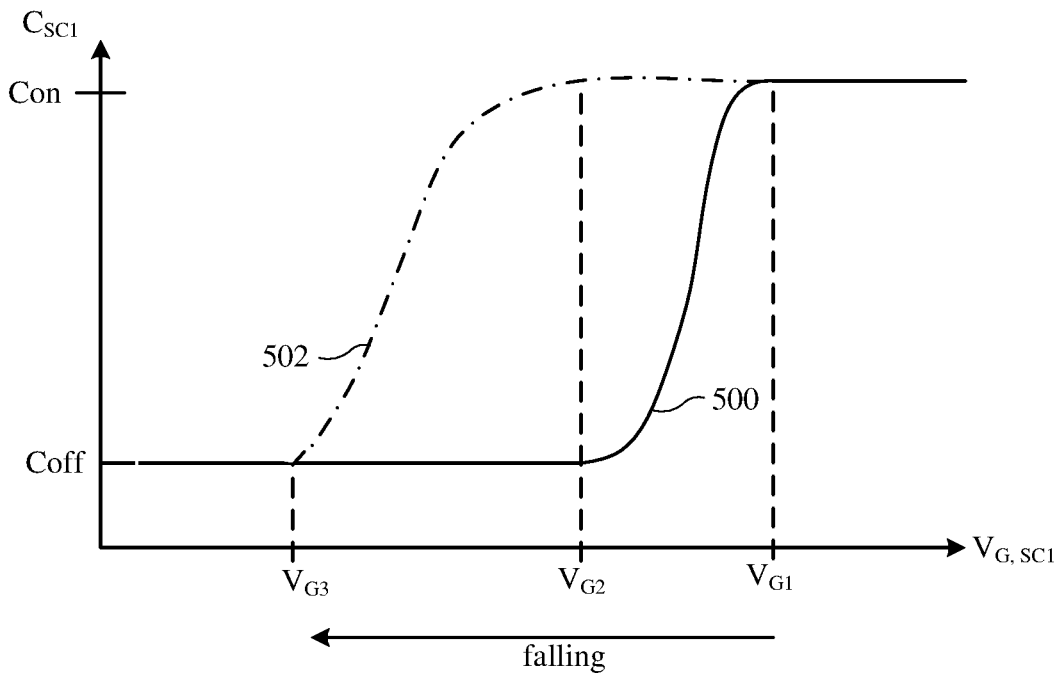
FIG. 5A is a diagram plotting the capacitance of an illustrative oxide thin-film transistor in accordance with an embodiment.

FIG. 5A is a diagram plotting the capacitance of transistor Toxide ($C_{SC1}$) as a function its gate terminal voltage (i.e., $V_{G,SC1}$). The notation "SC1" is used here because the first scan line signal SC1 directly biases the gate terminal of oxide transistor Toxide. Curve 500 illustrates how capacitance $C_{SC1}$ varies when a black data value is loaded into pixel 22, whereas curve 502 illustrates how capacitance $C_{SC1}$ varies when a gray data value is loaded into pixel 22. As shown in FIG. 5A, capacitance $C_{SC1}$ may be initially identical at the "on" capacitance value Con when voltage $V_{G,SC1}$ is high at $V_{G1}$. When voltage $V_{G,SC1}$ starts to fall (i.e., as the n-channel oxide transistor is being turned off), curve 500 may begin dropping while curve 502 remains high at Con. For instance, when voltage $V_{G,SC1}$ is equal to intermediate voltage level $V_{G2}$, curve 500 may have already descended to the "off" capacitance value Coff while curve 500 remains high at Con. Thereafter, voltage $V_{G,SC1}$ may decrease further, where both curves 500 and 502 are at the Coff level when $V_{G,SC1}$ is at or below $V_{G3}$. This difference in $C_{SC1}$ means that any rows with more black data values will exhibit capacitances falling off sooner in response to the falling edge of scan signal SC1, which translates to a smaller average scan line capacitance.

Figure 5B:
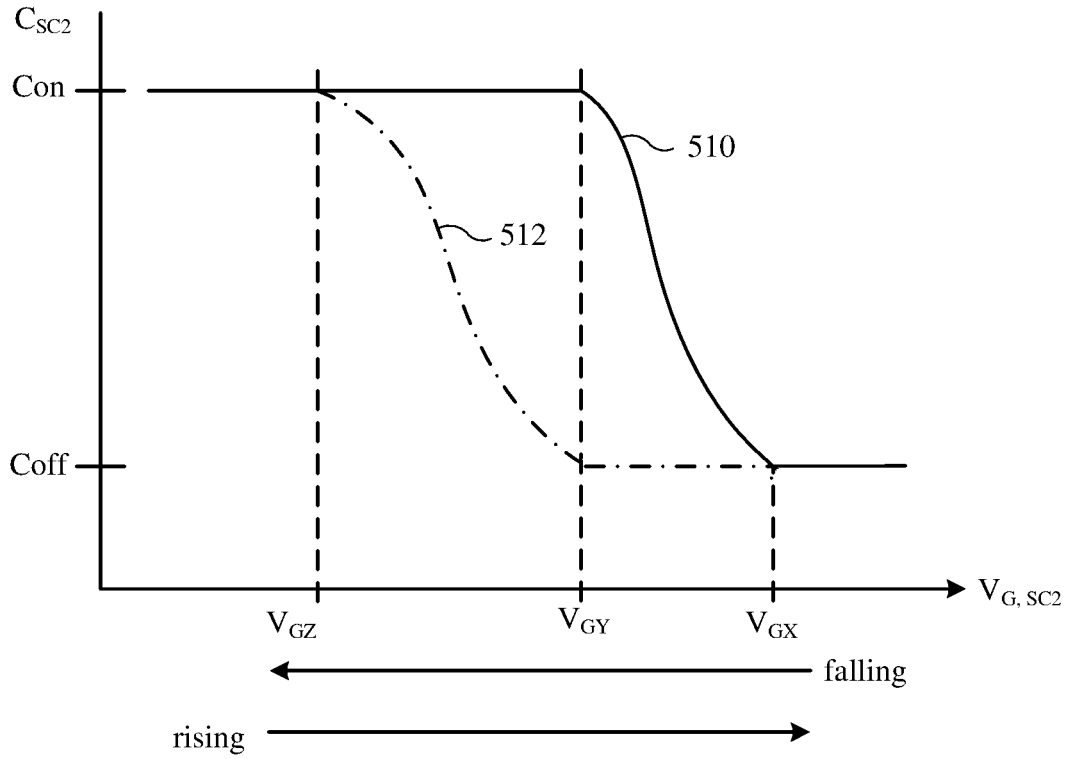
FIG. 5B is a diagram plotting the capacitance of an illustrative data loading thin-film transistor in accordance with an embodiment.

FIG. 5B is a diagram plotting the capacitance of data loading transistor Tdata ($C_{SC2}$) as a function its gate terminal voltage (i.e., $V_{G,SC2}$). The notation "SC2" is used here because the second scan line signal SC2 directly biases the gate terminal of transistor Tdata. Curve 510 illustrates how capacitance $C_{SC2}$ varies when a black data value is loaded into pixel 22, whereas curve 512 illustrates how capacitance $C_{SC2}$ varies when a gray data value is loaded into pixel 22.

As shown in FIG. 5B, capacitance $C_{SC2}$ may be initially identical at the "off" capacitance value Coff when voltage $V_{G,SC2}$ is high at $V_{GX}$. When voltage $V_{G,SC2}$ starts to fall (i.e., as the p-channel data loading transistor is being turned on), curve 510 may begin rising while curve 512 remains low at Coff. For instance, when voltage $V_{G,SC2}$ is equal to intermediate voltage level $V_{GY}$, curve 510 may have already risen to the "on" capacitance value Con while curve 512 remains low at Coff. Thereafter, voltage $V_{G,SC2}$ may decrease further, where both curves 510 and 512 reach the Con level when $V_{G,SC2}$ is at or below $V_{GZ}$. This difference in $C_{SC2}$ means that any rows with more black data values will exhibit capacitances rising sooner in response to the falling edge of scan signal SC2, which translates to a larger average scan line capacitance.

This effect is also manifested at the rising edge of scan signal SC2. Still referring to FIG. 5B, capacitance $C_{SC2}$ may be initially identical at Con when voltage $V_{G,SC2}$ is low at $V_{GZ}$. When voltage $V_{G,SC2}$ starts to rise (i.e., as the p-channel data programming transistor is being turned off), curve 512 may begin falling while curve 511 remains high at Con. For instance, when voltage $V_{G,SC2}$ is equal to intermediate voltage level $V_{GY}$, curve 512 may have already fallen to the "off" capacitance level Coff while curve 510 remains high at Con. Thereafter, voltage $V_{G,SC2}$ may rise further, where both curves 510 and 512 reach the Coff level when $V_{G,SC2}$ is at or above $V_{GX}$. This difference in $C_{SC2}$ means that any rows with more black data values will exhibit capacitances falling later in response to the rising edge of signal SC2, which again translates to a larger average scan line capacitance.

Figure 6A:
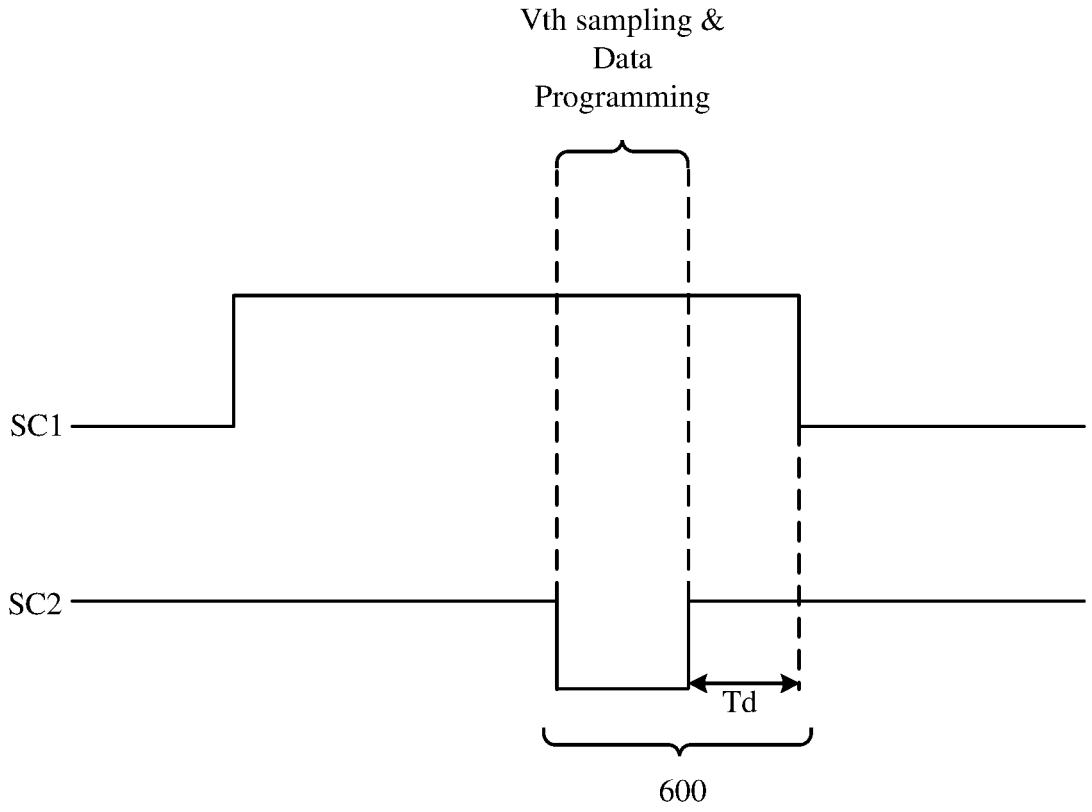
FIGS. 6A and 6B are timing diagrams illustrating how scan control signals may be pulsed in accordance with an embodiment.
Figure 6B:
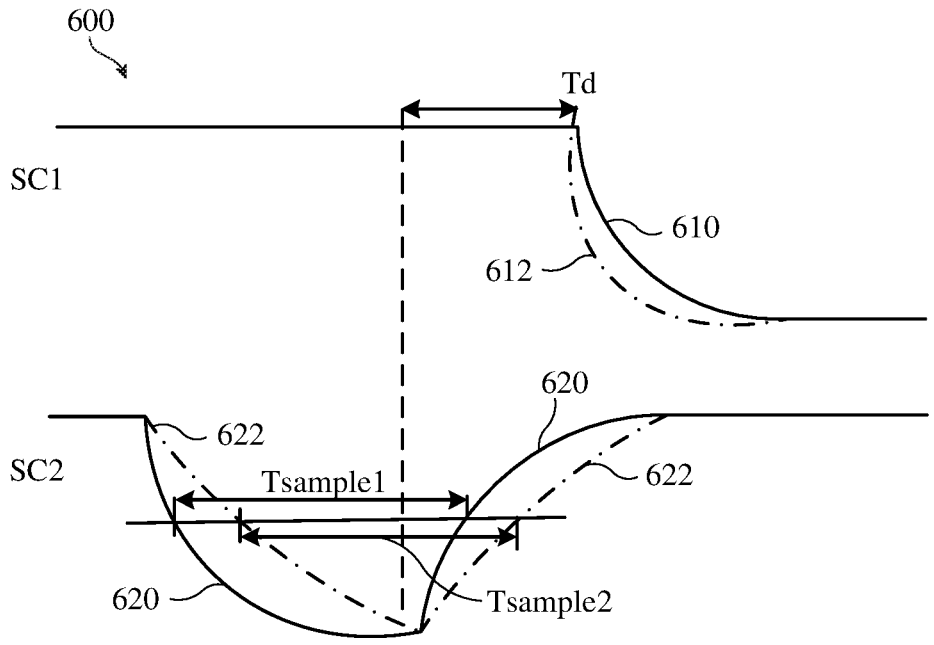

FIGS. 6A and 6B are timing diagrams illustrating how scan control signals SC1 and SC2 may be pulsed in accordance with an embodiment. As shown in FIG. 6A, first scan control signal SC1 may first be pulsed high (i.e., signal SC1 may be asserted). While signal SC1 is high, the second scan control signal SC2 may be pulsed low (e.g., to initiate the threshold voltage sampling and data programming phases of operation). Note that signal SC1 is controlling an n-channel transistor and is thus an active-high gate control signal (i.e., SC1 is asserted when it is driven high and deasserted when it is driven low), whereas signal SC2 is controlling a p-channel transistor and is thus an active-low gate control signal (i.e., SC2 is asserted when it is driven low and deasserted when it is driven high). The time period between the rising pulse edge of SC2 and the falling pulse edge of SC1 is defined as time delay period Td (see FIG. 6A), which is a predetermined time period that can be adjusted by display 14.

Aspects of the time period 600 in FIG. 6A near the pulse edges are illustrated in more detail in FIG. 6B. As shown in FIG. 6B, waveform 610 represents the falling response of scan line signal SC1 when loading the prescribed data values into row R1 (when loading in the same gray value into pixels 22-*la* and 22-1*b*). On the other hand, waveform 612 represents the falling response of scan line signal SC1 when loading the prescribed data values into row R2 (see, e.g., FIG. 4 when loading in a gray value into pixel 22-2*a* and a black value into pixel 22-2*b*). As described above in connection with FIG. 5A, rows with darker data exhibits a smaller average scan line capacitance. As a result, waveform 612 corresponds to a scan line with a smaller average capacitance, so it has a shorter/faster fall time, as illustrated in FIG. 6B.

Similarly, waveform 620 represents the pulse response of scan line signal SC2 when loading the prescribed data values into row R1 (when loading in the same gray value into pixels 22-1*a* and 22-1*b*). On the other hand, waveform 622 represents the pulse response of scan line signal SC2 when loading the prescribed data values into row R2 (see, e.g., FIG. 4 when loading in a gray value into pixel 22-2*a* and a black value into pixel 22-2*b*). As described above in connection with FIG. 5B, rows with darker data exhibits a greater average scan line capacitance. As a result, waveform 622 corresponds to a scan line with a larger average capacitance, so it has a longer/slower fall and rise time, as illustrated in FIG. 6B.

As a result, waveform 620 may exhibit a first pulse width Tsample1, which defines a first sampling duration for display pixel 22. Similarly, waveform 622 may exhibit a second pulse width Tsample2, which defines a second sampling duration for display pixel 22. Due to potential differences in the value of data signals being loaded into any given row of display pixels, the sampling duration might vary. The variation in the pulse width of scan control signal SC2 due to differences in the data values loaded into neighboring pixels in the same row (as illustrated by waveforms 620 and 622) is sometimes referred to herein as "horizontal crosstalk." Such type of horizontal crosstalk can cause inconsistencies in the Vth sampling phase, which can result in luminance non-uniformities across the display.

Moreover, the variation in the fall time of scan control signal SC1 (as illustrated by waveforms 610 and 612) may be indirectly coupled to the source terminal of transistor Tdrive (e.g., via parasitic capacitor Cpar in FIG. 3), which can cause a residue "kick" current to flow to the gate terminal of the drive transistor. Any temporal variation in when this kick current is generated will also result in variation of voltage Vg at the gate terminal of transistor Tdrive, which can make it even more challenging to fix the horizontal-crosstalk-induced luminance non-uniformities across the display.

Figure 7:
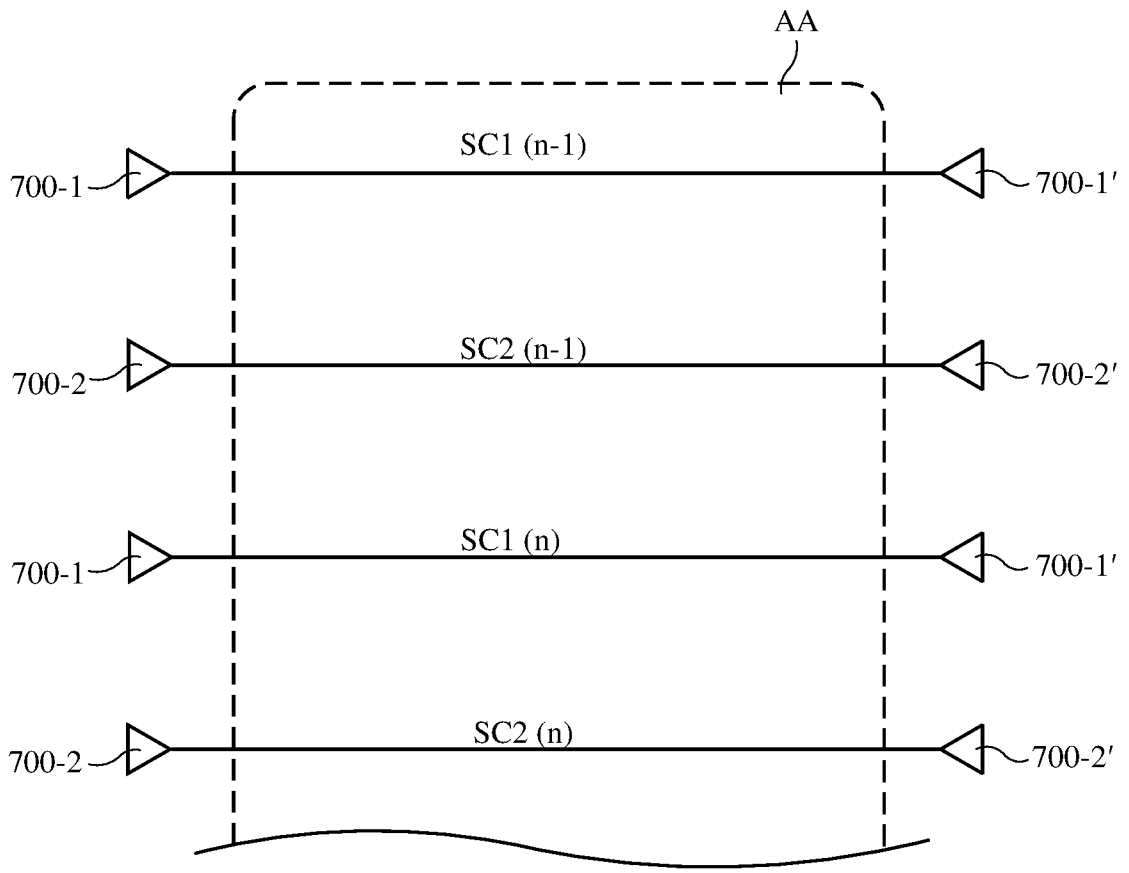
FIG. 7 is a diagram showing a symmetrical display driving scheme where each scan control signal is driven by two scan line drivers.

One way of mitigating the effects of such horizontal crosstalk and residue current is to use scan line drivers from both ends of each scan line (see FIG. 7). FIG. 7 is a diagram showing a symmetrical display driving scheme where each scan control signal SC1 and SC2 is driven by two scan line drivers. As shown in FIG. 7, each SC1 scan line is driven by row driver 700-1 formed outside the left edge of the active display region (marked as "AA") and by row driver 700-1' formed outside the right edge of active region AA. Similarly, each SC2 scan line is driven by row driver 700-2 formed along the left edge of active region AA and by row driver 700-2' formed along the right edge of active region AA. This arrangement in which each scan line signal is driven by two separate scan line drivers from opposing ends is sometimes referred to as a "head-to-head" driving scheme. Using this head-to-head driving scheme instead of only driving the scan lines from one end of the display panel can significantly improve (i.e., reduce) the rise and fall times of both scan line signals SC1 and SC2, which substantially reduces any adverse effects potentially caused by the horizontal crosstalk and parasitic kicking. Implementing a pure head-to-head driving scheme as shown in FIG. 7, however, takes up a significant amount of display border area while also consuming too much power.

Figure 8A:
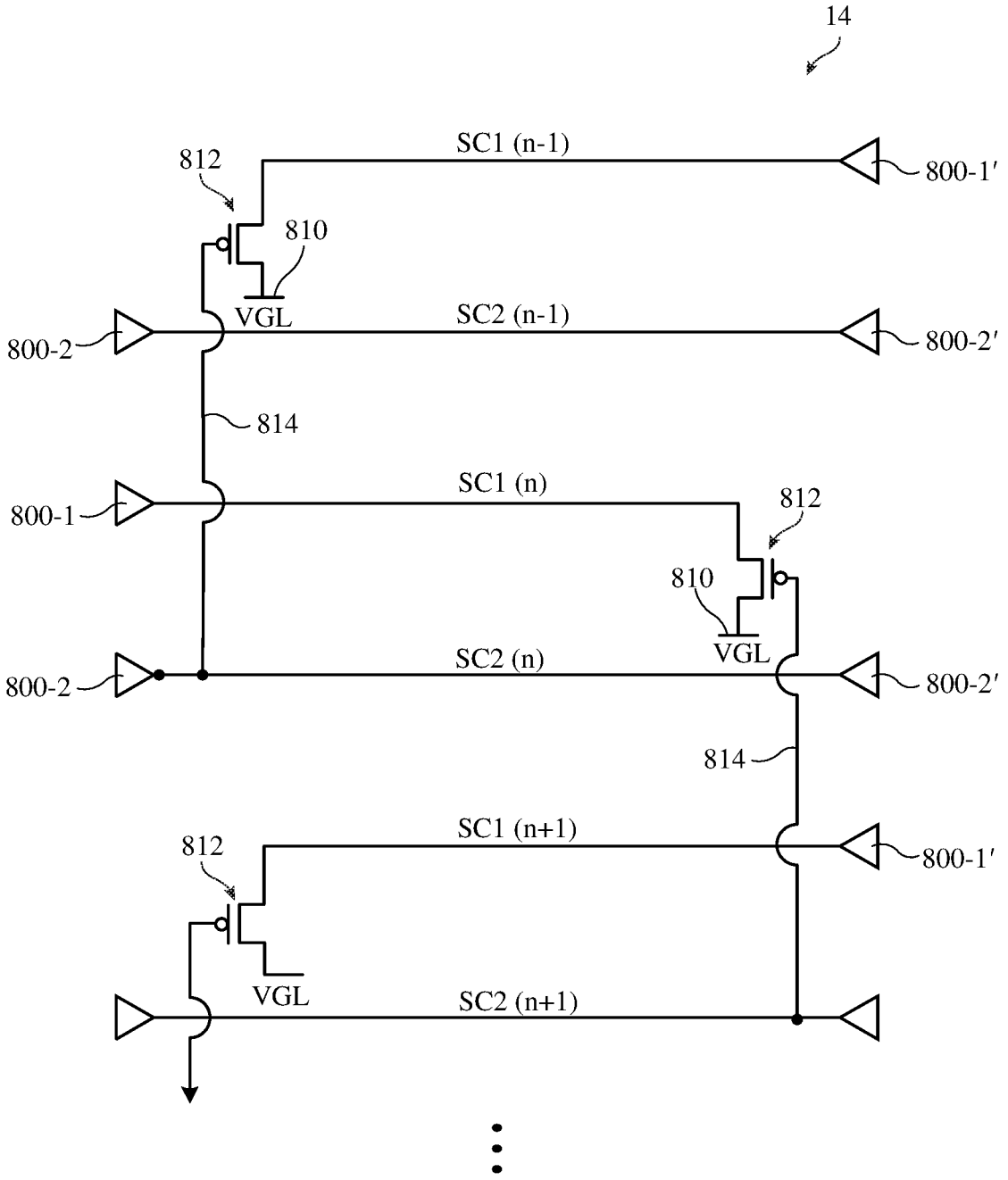
FIG. 8A is a diagram showing an asymmetric display driving scheme in which one of the scan control signals is driven by a peripheral driver circuit and an associated auxiliary pull-down transistor in accordance with an embodiment.

In accordance with an embodiment, a display 14 is provided where only the second scan line signals SC2 are driven using the head-to-head driving scheme while the first scan line signals SC1 are each driven using only one peripheral scan line driver circuit and an auxiliary pull-down circuit such as pull-down transistor 812 (see, e.g., FIG. 8A). A single auxiliary pull-down transistor 812 may suffice here for the SC1 signals since only the falling edge of SC1 is critical around the Vth sampling and data programming phase (see, e.g., FIGS. 6A and 6B). In other words, no auxiliary pull-up transistor is necessary since the pull-up performance of signal SC1 is not critical, which helps free up even more valuable circuit area.

In the example of FIG. 8A, each scan line signal SC2 may be driven by peripheral scan line driver 800-2 formed near the left edge of display 14 and peripheral scan line driver 800-2 formed near the right edge of display 14. In contrast, the first scan line signal SC1($n$−1) may be driven by scan line driver 800-1' formed at the right edge of display 14 and is selectively driven low to ground voltage VGL provided over power supply line 810 using a corresponding first auxiliary pull-down transistor 812 (e.g., a p-type thin-film transistor). Second scan line signal SC1($n$) may be driven by scan line driver 800-1 formed at the left edge of display 14 and may be selectively driven low to VGL using a corresponding second auxiliary pull-down transistor 812. Third scan line signal SC1($n$+1) may be driven by scan line driver 800-1' formed at the right edge of display 14 and may be selectively driven low to VGL using a corresponding third auxiliary pull-down transistor 812.

The first pull-down transistor 812 may be controlled by signal SC2($n$) (e.g., the first auxiliary transistor has a gate terminal that directly receives SC2($n$) via a first feedback path 814). The second pull-down transistor 812 may be controlled by signal SC2($n$+1) (e.g., the second auxiliary transistor has a gate terminal that directly receives SC2($n$+1) via a second feedback path 814). The third auxiliary pull-down transistor 812 may also receive SC2 from a subsequent row (not shown). This type of asymmetrical driving scheme where signals SC1 are driven from alternating sides of the display and where the auxiliary pull-down transistors are controlled using feedback paths 814 from subsequent rows may be used to drive a display 14 with any suitable number of rows. If desired, a dummy row near the bottom edge may be inserted to help turn on pull-down transistor 812 in the last active display pixel row.

In the scenario where display pixel 22 includes more thin-film transistors configured to receive additional scan line signals (e.g., SC3, SC4, etc.), any of the additional scan line signals may be biased using a head-to-head driving scheme (if rising and falling edge performance is equally important), a pure single-ended driving scheme (if neither the rising nor falling edge performance is crucial), or a hybrid drive scheme having one peripheral row driver with an associated auxiliary pull-down circuit (if the falling edge is the more important transition) or an associated auxiliary pull-up circuit (if the rising edge is the more important transition).

Figure 8B:
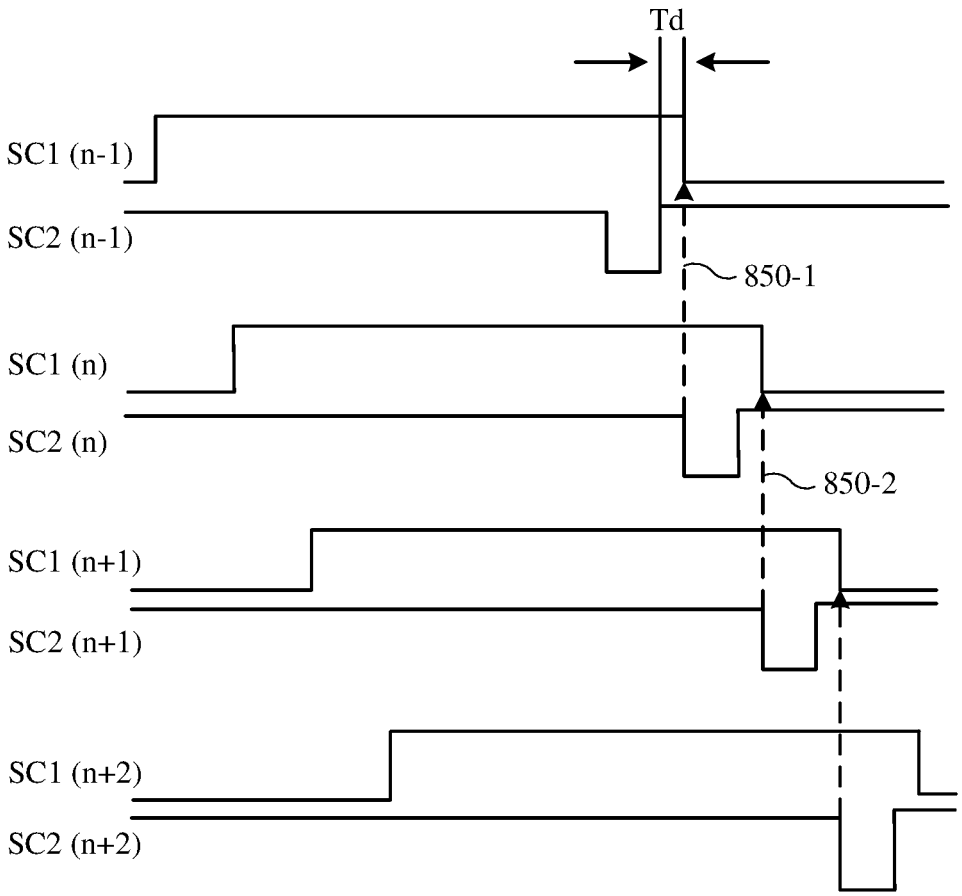
FIG. 8B is a timing diagram illustrating the operation of the display shown in FIG. 8A in accordance with an embodiment.

FIG. 8B is a timing diagram illustrating the operation of the display shown in FIG. 8A. As shown in FIG. 8B, the leading pulse edge of signal SC2($n$) effectively turns on the pull-down transistor 812 in the first row, which triggers the falling edge of signal SC1($n$−1) as indicated by arrow 850-1. Similarly, the leading pulse edge of signal SC2($n$+1) effectively turns on the pull-down transistor 812 in the second row, which triggers the falling edge of signal SC1($n$) as indicated by arrow 850-2. In this example, each SC1 signal is triggered by SC2 in the immediate succeeding row. This results in a relatively small delay period Td.

Figure 9A:
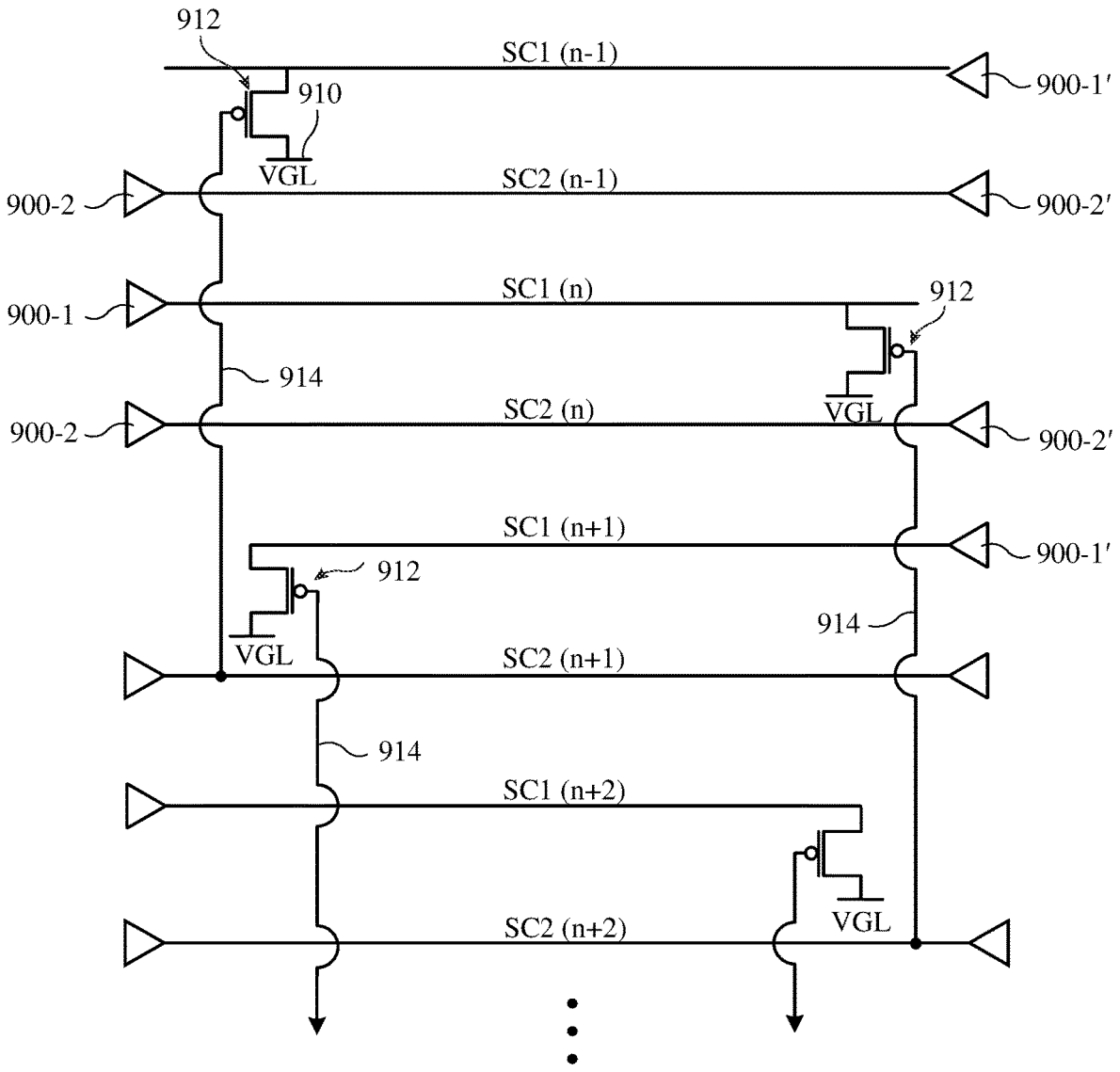
FIG. 9A is a diagram illustrating another display driving scheme in which the auxiliary pull-down transistor is controlled by a signal fed back from a non-adjacent row in accordance with an embodiment.

FIG. 9A illustrates another suitable arrangement in which the auxiliary pull-down transistor is controlled by a SC2 signal fed back from at least two rows down. As shown in FIG. 9A, each scan line signal SC2 may be driven by peripheral scan line driver 900-2 formed along the left edge of display 14 and peripheral scan line driver 900-2 formed along the right edge of display 14. In contrast, the first scan line signal SC1($n$−1) may be driven by scan line driver 900-1' formed at the right edge of display 14 and is selectively driven low to ground voltage VGL provided over power supply line 910 using a corresponding first auxiliary pull-down transistor 912 (e.g., a p-type thin-film transistor). Second scan line signal SC1($n$) may be driven by scan line driver 900-1 formed at the left edge of display 14 and may be selectively driven low to VGL using a corresponding second auxiliary pull-down transistor 912. Third scan line signal SC1($n$+1) may be driven by scan line driver 900-1' formed at the right edge of display 14 and may be selectively driven low to VGL using a corresponding third auxiliary pull-down transistor 912.

The first pull-down transistor 912 may be controlled by signal SC2($n$+1) (e.g., the first auxiliary transistor has a gate terminal that directly receives SC2($n$+1) via a first feedback path 914 traversing the second row). The second pull-down transistor 912 may be controlled by signal SC2($n$+2) (e.g., the second auxiliary transistor has a gate terminal that directly receives SC2($n$+2) via a second feedback path 914 that traverses the third row). The third auxiliary pull-down transistor 912 may also receive SC2 from a subsequent non-adjacent row (not shown). This type of asymmetrical driving scheme where signals SC1 are driven from alternating sides of the display and where the auxiliary pull-down transistors are controlled using feedback paths 914 from subsequent non-adjacent rows may be used to drive a display 14 with any suitable number of rows. If desired, a dummy row near the bottom edge may be inserted to help turn on pull-down transistor 912 in the last active display pixel row.

Figure 9B:
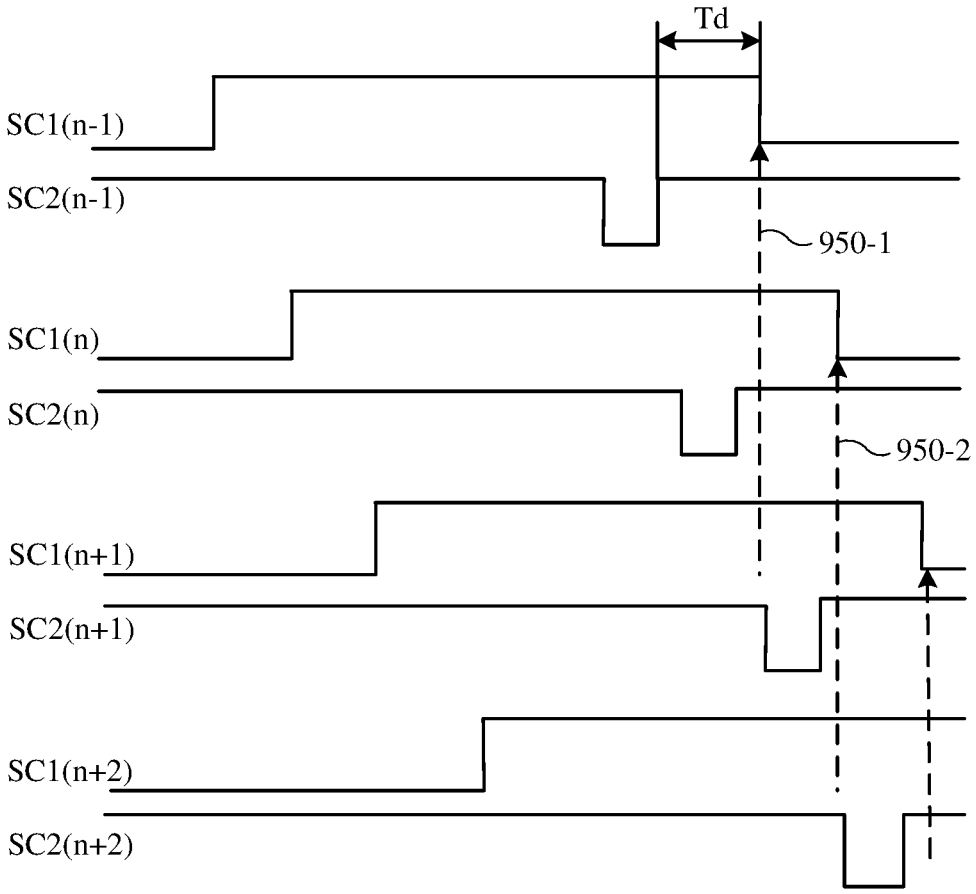
FIG. 9B is a timing diagram illustrating the operation of the display shown in FIG. 9A in accordance with an embodiment.

FIG. 9B is a timing diagram illustrating the operation of the display shown in FIG. 9A. As shown in FIG. 9B, the leading pulse edge of signal SC2($n$+1) effectively turns on the pull-down transistor 912 in the first row, which triggers the falling edge of signal SC1($n$−1) as indicated by arrow 950-1. Similarly, the leading pulse edge of signal SC2($n$+2) effectively turns on the pull-down transistor 912 in the second row, which triggers the falling edge of signal SC1($n$) as indicated by arrow 950-2. In this example, each SC1 signal is triggered by SC2 two rows down. This results in a relatively larger delay period Td.

Figure 10:
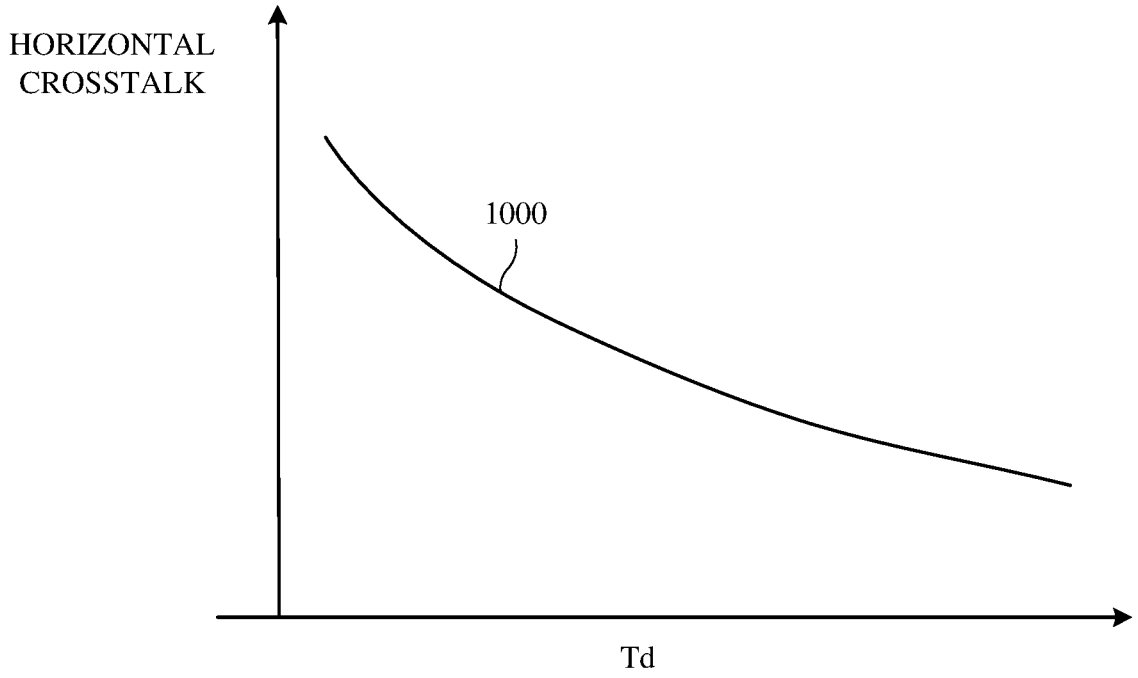
FIG. 10 is a plot illustrating how horizontal crosstalk can be reduced by adjusting a delay period in accordance with an embodiment.

FIG. 10 is a plot illustrating how horizontal crosstalk can be reduced by adjusting delay period Td in accordance with an embodiment. As shown in FIG. 10, curve 1000 represents the amount of undesired horizontal crosstalk, which decreases as delay period Td is increased. As a result, it may be desirable to lengthen Td as much as possible without degrading the performance of display 14. Thus, the example described in connection with FIGS. 9A and 9B that yields a larger delay time Td relative to the example described in connection with FIGS. 8A and 8B may be more desirable in terms of achieving reduced horizontal crosstalk. These examples are, however, merely illustrative and are not intended to limit the scope of the present embodiments. If desired, each auxiliary pull-down transistor may triggered or activated by the scan line signal fed back from at least three rows below, from at least four rows below, from five to ten rows below, from more than ten rows below, etc.

Figure 11:
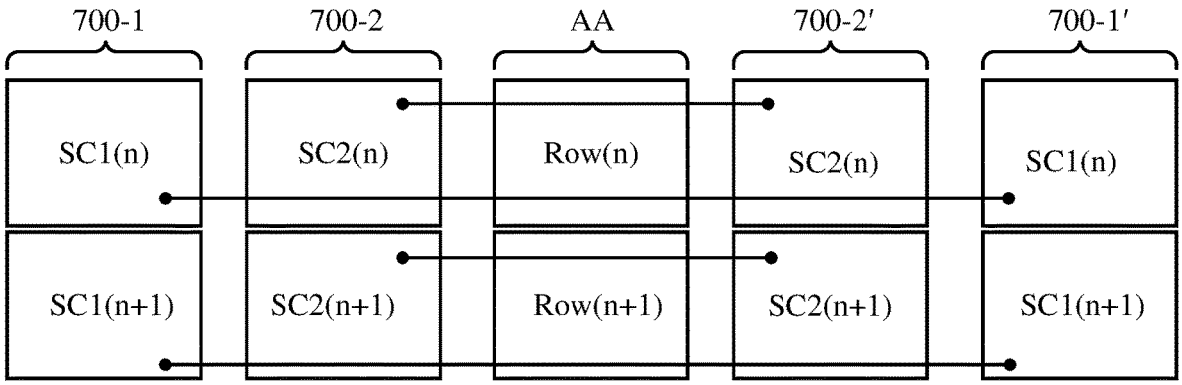
FIG. 11 is a top layout view of the display shown in FIG. 7.

FIG. 11 is a top layout view showing two illustrative rows of the display of FIG. 7. As shown in FIG. 11, the display pixels are formed in the active area AA of the display, which are flanked on either side by SC1 drivers 700-1 and SC2 drivers 700-2 from the left and by SC1 drivers 700-1' and SC2 drivers 700-2' from the right. Having a head-to-head driving configuration for both scan line signals SC1 and SC2 takes up a substantial amount of display border area while also consuming a lot of power.

Figure 12:
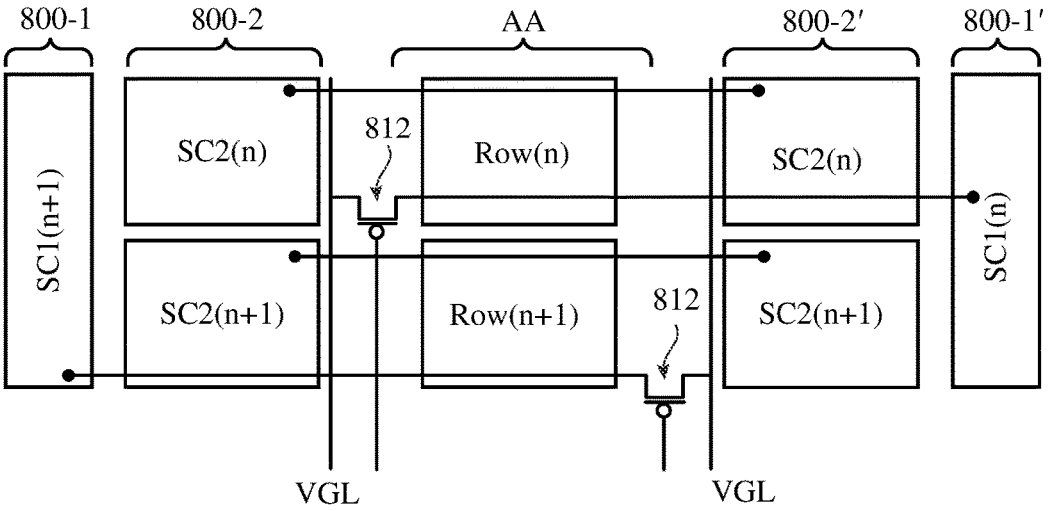
FIG. 12 is a top layout view of an illustrative display of the type shown in connection with FIGS. 8-9 having a reduced border region in accordance with an embodiment.

FIG. 12 is a top layout view showing two illustrative rows of display 14 of the type described in connection with FIG. 8 (and also FIG. 9). As shown in FIG. 12, the display pixels are formed in the active region AA of display 14. The SC2 driver circuits 800-2 and 800-2' still formed on both sides of the AA region for each row. For row "n", only one SC1 driver 800-1' is formed on the right peripheral edge with a small auxiliary pull-down transistor 812 configured to drive that row low. Similarly, for now "n+1", only one SC1 driver 800-1 is formed on the left peripheral edge with a small auxiliary pull-down transistor 812 configured to drive that row low. Comparing FIG. 12 to FIG. 11, it is clear that the arrangement of FIG. 12 exhibits a much narrower display border with since the total size of the SC1 drivers is halved, which also helps reduce power consumption.

Figure 13:
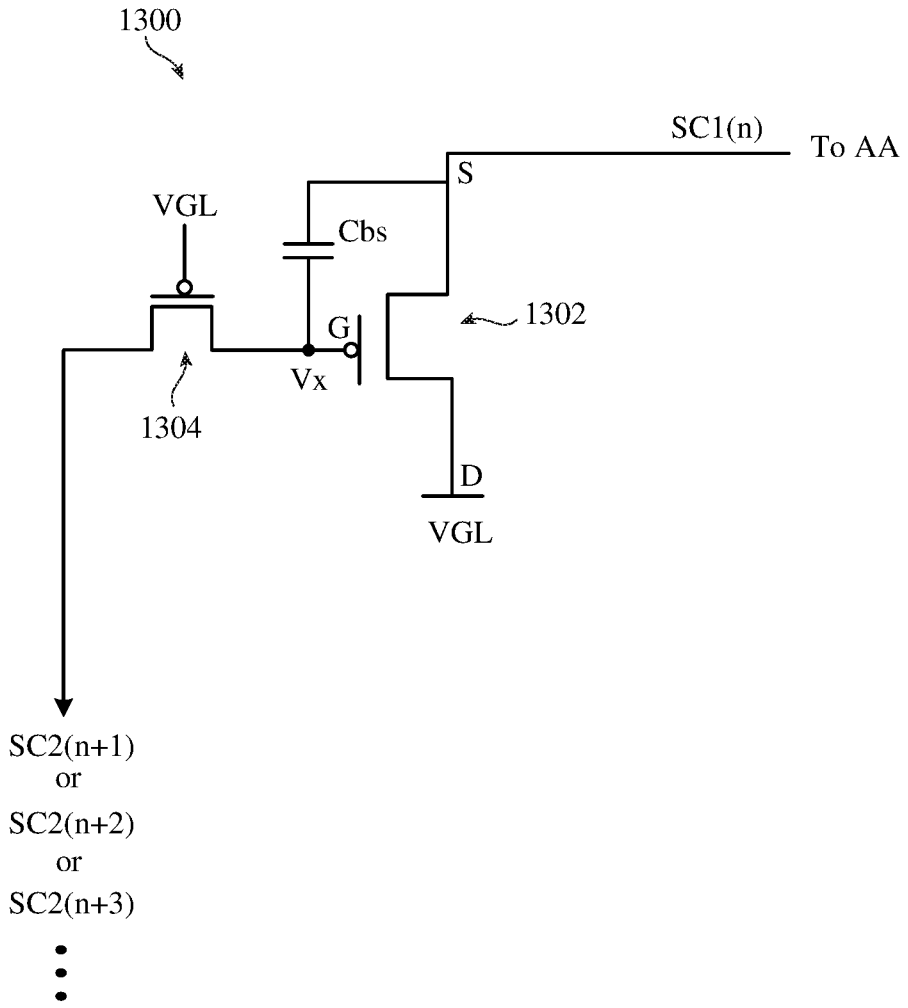
FIG. 13 is circuit diagram showing an illustrative bootstrapped pull-down circuit in accordance with an embodiment.

The arrangements of FIGS. 8A, 9A, and 12 where each auxiliary pull-down circuit is implemented using a single pull-down transistor is merely illustrative. FIG. 13 illustrates another suitable arrangement where each auxiliary pull-down circuit is also provided with bootstrapping circuitry.

As shown in FIG. 13, auxiliary pull-down circuit 1300 includes a pull-down transistor 1302 (e.g., a p-type thin-film semiconducting-oxide transistor or silicon transistor), a bootstrapping capacitor Cbs coupled across the source and gate terminals of transistor 1302, and a series transistor 1304 interposed between the gate terminal of pull-down transistor 130-2 and the feedback path, which optionally receives trigger signal SC(n+1) from one row below, SC(n+2) from two rows below, SC(n+3) from three rows below, etc. Series transistor 1304 (e.g., a p-type thin-film semiconducting-oxide transistor or silicon transistor) has a gate terminal configured to receive ground power supply signal VGL. Configured in this way, capacitor Cbs and series transistor 1304 are used to pull gate voltage Vx below the VGL level, which further decreases the on resistance of pull-down transistor 1302. Overdriving pull-down transistor 1302 in this way can improve the pull-down drive strength of auxiliary pull-down circuit 1300, which further improves fall time performance and reduces display luminance non-uniformity. This technique may be applied to the driving scheme shown in FIGS. 8, 9, and 12.

The configuration of FIG. 13 in which a bootstrapping capacitor Cbs and a series p-channel transistor 1304 are used as bootstrapping structures to help overdrive pull-down transistor 1302 is merely illustrative. In general, other suitable circuit implementations for pulling gate voltage Vx (i.e., the gate voltage of pull-down transistor 1302) below ground voltage VGL or VSSEL may be used.

The foregoing is merely illustrative and various modifications can be made to the described embodiments. The foregoing embodiments may be implemented individually or in any combination.

What is claimed is:

1. A display, comprising:

an array of pixels arranged in rows and columns;

a first scan line configured to provide a first scan line signal to pixels in a first row in the array;

a second scan line configured to provide a second scan line signal to the pixels in the first row in the array;

first and second peripheral driver circuits configured to drive the second scan line signal on the second scan line;

a third peripheral driver circuit configured to drive the first scan line signal on the first scan line, wherein the first scan line signal is asserted by only the third peripheral driver circuit, and wherein the third peripheral driver is formed along a first edge of the array of pixels; and an auxiliary pull-down circuit coupled to the first scan line and activated by another scan line signal from a second row in the array, wherein the auxiliary pull-down circuit is formed along a second edge of the array of pixels opposing the first edge.

2. The display of claim 1, wherein the first and second peripheral driver circuits are formed on opposing sides of the array.

3. The display of claim 2, wherein the first and second peripheral driver circuits are configured to pulse the second scan line signal on the second scan line.

4. The display of claim 1, wherein the auxiliary pull-down circuit is only configured to deassert the first scan line signal.

5. The display of claim 1, wherein the auxiliary pull-down circuit comprises a p-type thin-film transistor.

6. The display of claim 1, wherein the second row is adjacent to the first row in the array.

7. The display of claim 1, wherein the second row is non-adjacent to the first row in the array.

8. The display of claim 1, wherein the auxiliary pull-down circuit is overdriven to decrease the on resistance of the auxiliary pull-down circuit.

9. The display of claim 8, wherein the auxiliary pull-down circuit is overdriven using associated bootstrapping circuitry.

10. The display of claim 9, wherein the auxiliary pull-down circuit comprises:

a pull-down thin-film transistor having a source terminal connected to the first scan line, a drain terminal connected to a ground power supply line, and a gate terminal;

a bootstrapping capacitor coupled between the gate and source terminals of the pull-down transistor; and an additional thin-film transistor connected to the gate terminal of the pull-down transistor, wherein the additional thin-film transistor has a gate terminal connected to the ground power supply line.

11. The display of claim 1, wherein each pixel in the first row in the array comprises:

an organic light-emitting diode;

a drive transistor coupled in series with the organic light-emitting diode, wherein the drive transistor has a gate terminal, a drain terminal, and a source terminal; and an additional transistor connected across the gate and drain terminals of the drive transistor, wherein the additional transistor has a gate terminal configured to receive the first scan line signal.

12. The display of claim 11, wherein each pixel in the first row in the array further comprises:

a data loading transistor coupled to the source terminal of the drive transistor, wherein the data loading transistor has a gate terminal configured to receive the second scan line signal.

13. The display of claim 12, wherein the drive transistor is a first type of thin-film transistor, and wherein the additional transistor is a second type thin-film transistor that is different than the first type.

14. The display of claim 13, wherein the drive transistor is a p-type transistor, and wherein the additional transistor is an n-type transistor.

15. The display of claim 13, wherein the drive transistor is a silicon thin-film transistor, and wherein the additional transistor is a semiconducting-oxide thin-film transistor.

16. A display, comprising:

a display pixel that comprises:

an organic light-emitting diode; and a plurality of thin-film transistors that is coupled to the organic light-emitting diode and that is configured to receive a first scan control signal via a first scan line and a second scan control signal via a second scan line different than the first scan line, wherein the second scan line is symmetrically driven, and wherein the first scan line is asymmetrically driven;

a plurality of peripheral driver circuits configured to drive the second scan control signal on the second scan line;

a single peripheral driver circuit configured to drive the first scan control signal on the first scan line; and an auxiliary driver circuit configured to assist the single peripheral driver circuit in driving the first scan control signal from a first voltage level to a second voltage level different than the first voltage level, wherein the auxiliary pull-down circuit comprises:

a pull-down transistor having a first source-drain terminal coupled to the first scan line, a second source-drain terminal coupled to a ground power supply line, and a gate terminal; and a capacitor coupled between the gate and first source-drain terminals of the pull-down transistor.

17. The display of claim 16, wherein the auxiliary pull-down circuit further comprises an additional transistor having a source-drain terminal coupled to the gate terminal of the pull-down transistor and having a gate terminal coupled to the ground power supply line.

18. A method of operating a display, the method comprising:

with a scan line driver formed on a first side of the display, providing a first scan signal to a pixel in the display;

with a pair of scan line drivers formed on opposing sides of the display, providing a second scan signal to the pixel in the display;

pulsing the first scan signal to activate a first transistor in the pixel, wherein the first scan signal has a rising pulse edge and a falling pulse edge;

while the first scan signal is pulsed, pulsing the second scan signal to activate a second transistor in the pixel, wherein the second scan signal has a falling pulse edge and a rising pulse edge;

delaying the time period between the rising pulse edge of the second scan signal and the falling pulse edge of the first scan signal to reduce horizontal crosstalk on the display; and with an auxiliary pull-down circuit formed on a second side of the display opposing the first side, assisting the scan line driver in pulling down the first scan signal.

19. The method of claim 18, wherein the pixel comprises an organic light-emitting diode coupled to a drive transistor, wherein the drive transistor has a threshold voltage, and wherein the pulsing the second scan signal comprises performing a threshold voltage sampling and data programming operation on the pixel.

20. The method of claim 18, wherein the first scan signal is asymmetrically driven.

21. The method of claim 20, wherein the second scan signal is symmetrically driven using the pair of scan line drivers.

* * * * *